US007938754B2

(12) United States Patent
Eschenbach

(10) Patent No.: US 7,938,754 B2
(45) Date of Patent: May 10, 2011

(54) FREE STRIDE ELLIPTICAL EXERCISE APPARATUS

(76) Inventor: Paul William Eschenbach, Roebuck, SC (US)

( * ) Notice: Subject to any disclaimer, the term of this patent is extended or adjusted under 35 U.S.C. 154(b) by 2 days.

(21) Appl. No.: 12/590,809

(22) Filed: Nov. 16, 2009

(65) Prior Publication Data

US 2011/0065551 A1 Mar. 17, 2011

Related U.S. Application Data

(60) Provisional application No. 61/276,701, filed on Sep. 16, 2009.

(51) Int. Cl.
*A63B 22/04* (2006.01)

(52) U.S. Cl. ..... 482/52

(58) Field of Classification Search ..... 482/51–53, 482/57, 62, 70–71; *A63B 22/04*
See application file for complete search history.

(56) References Cited

U.S. PATENT DOCUMENTS

| | | | | |
|---|---|---|---|---|
| 6,422,977 | B1 * | 7/2002 | Eschenbach | 482/52 |
| 7,507,184 | B2 | 3/2009 | Rodgers, Jr. | 482/52 |
| 7,520,839 | B2 | 4/2009 | Rodgers, Jr. | 482/52 |
| 7,608,018 | B2 * | 10/2009 | Chuang et al. | 482/52 |
| 7,678,025 | B2 * | 3/2010 | Rodgers, Jr. | 482/52 |
| 2009/0105049 | A1 | 4/2009 | Miller | 482/52 |
| 2009/0156369 | A1 | 6/2009 | Rodgers, Jr. | 482/52 |
| 2009/0156370 | A1 | 6/2009 | Rodgers, Jr. | 482/52 |
| 2009/0181828 | A1 | 7/2009 | Rodgers, Jr. | 482/52 |
| 2009/0203501 | A1 | 8/2009 | Rodgers, Jr. | 482/52 |

* cited by examiner

*Primary Examiner* — Loan Thanh
*Assistant Examiner* — Oren Ginsberg

(57) ABSTRACT

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator. The exercise apparatus is easy to start and has generally elliptical shaped curves throughout stride variations.

20 Claims, 2 Drawing Sheets

FREE STRIDE ELLIPTICAL EXERCISE APPARATUS

This application is based on material submitted in the U.S. Provisional Application No. 61/276,701 filed on Sep. 16, 2009. with confirmation No. 6812.

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market referred to as user defined motion elliptical cross trainers. These cross trainers guide the feet along a closed loop shaped curve to simulate the motions of jogging and climbing with varying stride lengths. The shorter stride lengths have pedals which follow closed loop curves that are generally elliptical in shape. However, the longer stride lengths have pedals which follow closed loop curves having more of a banana shape than elliptical. Often, user defined motion ellipticals are considered hard to start by many users. There is a need for a variable stride exercise apparatus capable of long, medium and shorter stride lengths where the pedals always follow generally elliptical curve paths that is easy to start.

User defined motion elliptical cross trainers without cams are shown in Rodgers, Jr. US Patent Applications 2009/0181828 and 2009/0156369 as well as U.S. Pat. Nos. 7,520,839 and 7,530,626 which show a pendulum striding exercise apparatus having foot support members hung from generally horizontal pivoted beams driving cranks to achieve the varying stride length pedal curves. Rodgers, Jr. in US Patent Applications 2009/0156370, 2009/0203501 and U.S. Pat. No. 7,507,184 show exercise apparatus with flexible support elements having varying stride lengths. Miller in US Patent Application 2009/0105049 also shows an exercise apparatus having varying stride lengths.

It is an objective of this invention to provide an improved exercise apparatus having varying stride lengths determined by the movement of an operator that is easy to start. A further objective is to provide an exercise apparatus having varying stride lengths where the pedals follow elliptical curves for short, medium and long stride lengths.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong curve motion while pedal angles are controlled to vary about the horizontal during the pedal cycle. Arm exercise is by handles coordinated with the mechanism guiding the foot pedals. The range of handle movement determines the pedal stride length.

In the preferred embodiment, the apparatus includes a separate pedal for each foot attached to a foot support member. A pair of crank arms rotate about a pivot axis positioned on the framework. A pair of support links are pivotally connected to the crank arms and to foot support members. A pair of tracks are supported by the framework where a track actuator can change the incline. A pair of rollers are each pivotally attached to a respective foot support member and maintain rollable contact with a respective track. A pair of handles are pivotally connected to the framework. A pair of connector links are pivotally connected to the handles and to the support links. A cross member is pivotally connected to the framework. A pair of crossing links are pivotally connected to the cross member and to each handle. The crossover member and crossing links form a crossover assembly to cause one handle to move forward while the other handle moves rearward.

The stride length of the pedal is determined by the range of movement of the handle. The shortest stride length occurs with no movement of the handles while the longest stride length of the pedals occurs with the longest range of movement of the handles.

Load resistance is applied to the crank in this embodiment by a pulley which drives a belt to a smaller pulley attached to a flywheel supported by the framework. A tension belt covers the circumference of the flywheel to provide friction for load resistance on the intensity of exercise. A control system can adjust the tension on the tension belt through a load actuator to vary the intensity of exercise. It should be understood that other forms of load resistance such as magnetic, alternator, air fan or others may be applied to the crank. The control system also can adjust the incline of the tracks with the track actuator during operation to further change the intensity of exercise.

In summary, this invention provides the operator with an exercise apparatus that is easy to start having varying elliptical stride lengths with stable foot pedal support that simulate walking and jogging with very low joint impact. Pedal curves remain elliptical in shape throughout the range of variation.

DETAILED DESCRIPTION OF THE EMBODIMENTS

Figure 1:
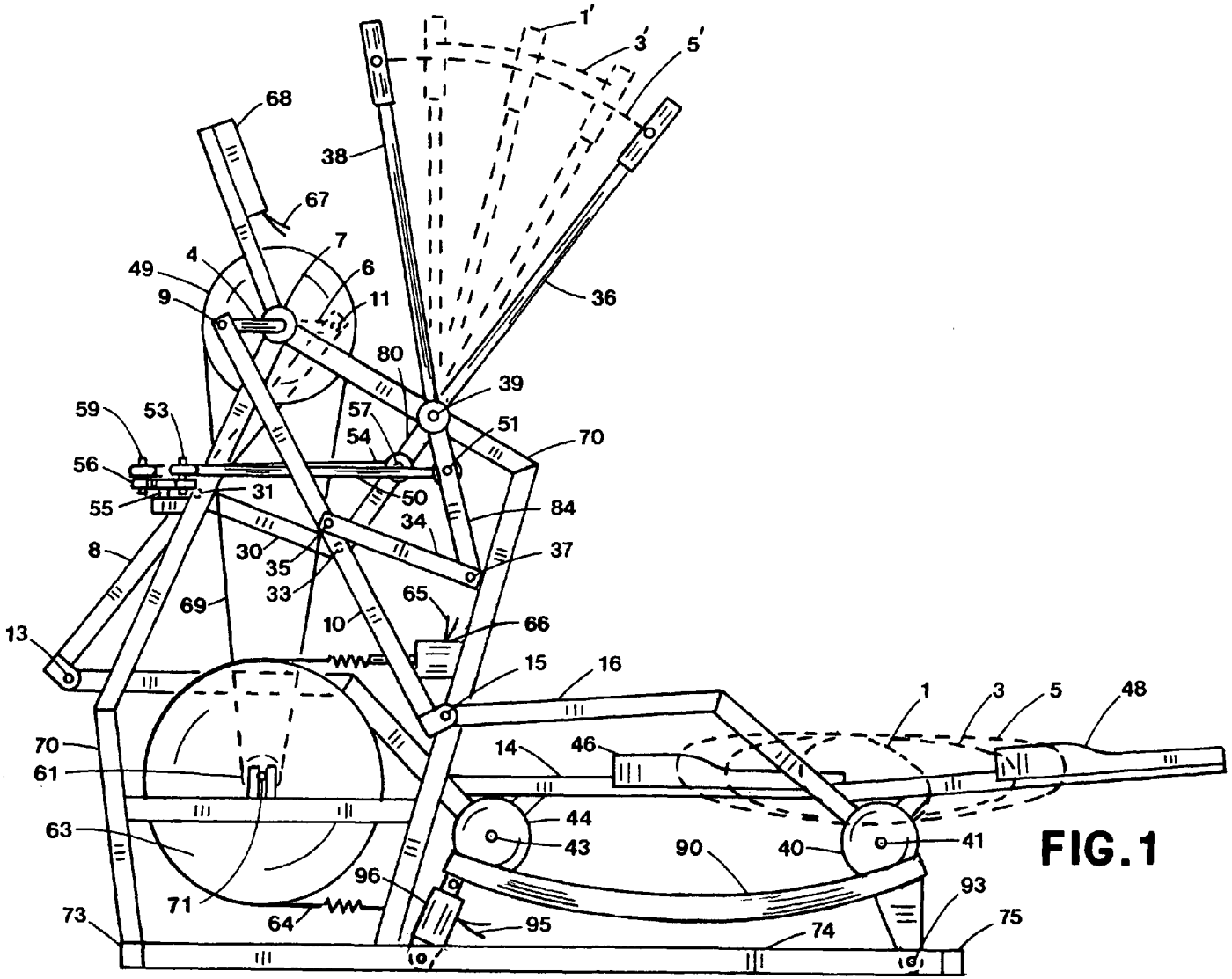
FIG. 1 is a right side elevation view of the preferred embodiment of an exercise machine constructed in accordance with the present invention.
Figure 2:
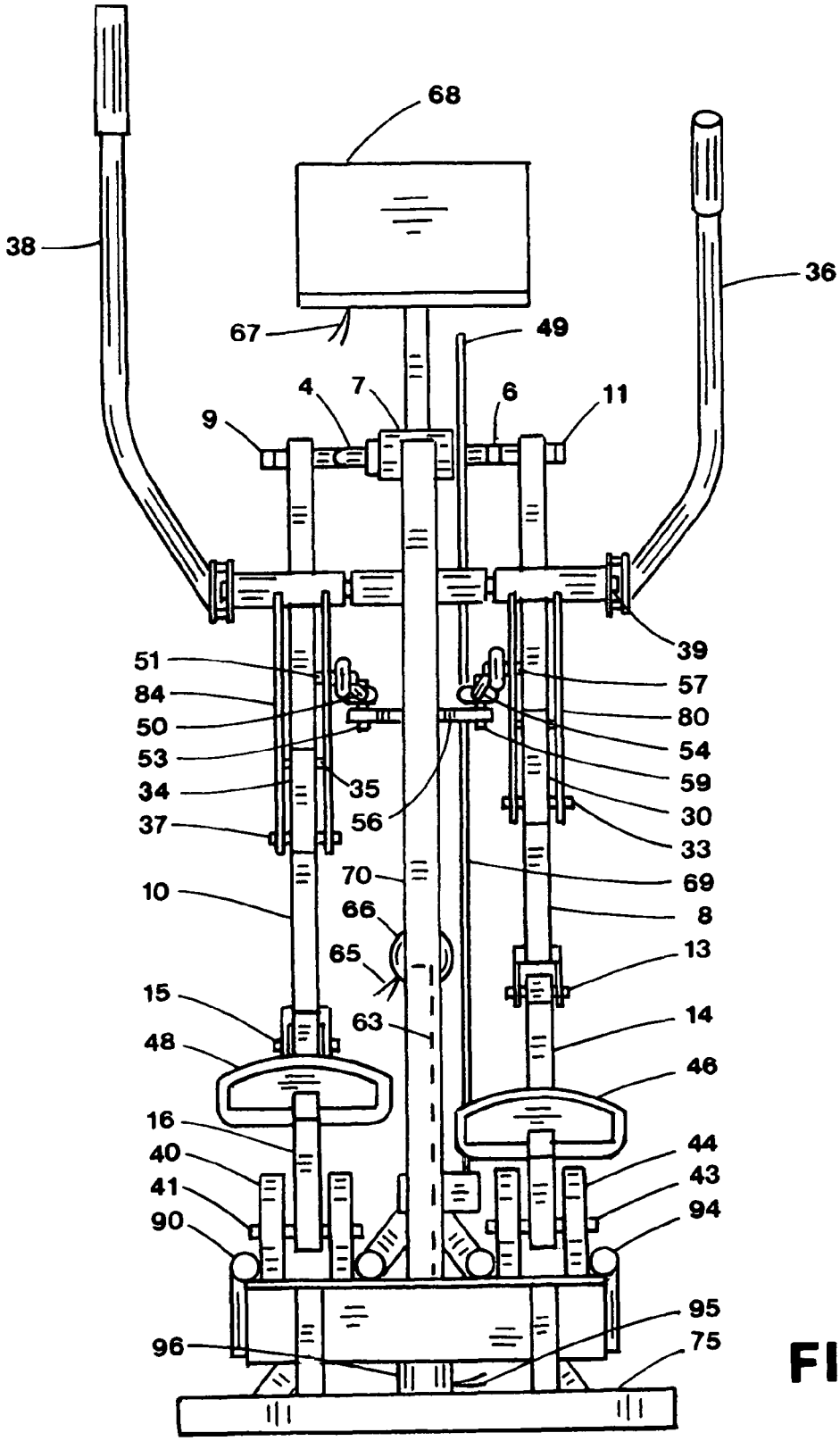
FIG. 2 is the rear view of the preferred embodiment shown in FIG. 1.

Referring to the drawings in detail, pedals 46 and 48 are shown in FIGS. 1 and 2 in forward and rearward positions of the preferred embodiment. Crank arms 4,6 rotate about pivot axis 7 on framework 70. Foot support members 14,16 have pedals 46,48 attached. Support links 8,10 are connected to crank arms 6,4 at pivots 11,9 and to foot support members 14,16 at pivots 13,15. Tracks 90,94 are attached to frame members 74 at pivot 93 and to track actuator 96 which is also attached to framework 74. Rollers 40,44 are connected to foot support members 16,14 at pivots 41,43 and are in rollable contact with tracks 90,94.

Handles 36,38 are connected to framework 70 at pivot 39 and have handle extensions 80,84. Connector links 30,34 are connected to handle extensions 80,84 at pivots 33,37 and to support links 8,10 at pivots 31,35. Crossover member 56 is connected to framework 70 at pivot 55. Crossing links 50,54 are connected to crossover member 56 at pivots 53,59 and to handle extensions 84,80 at pivots 51,57. Crossover member 56 and crossing links 50,54 form a crossover assembly as shown in FIGS. 1 and 2 that cause handle 36 to move forward when handle 38 moves rearward.

Load resistance is imposed upon cranks 4,6 by pulley 49 which drives flywheel 63 by belt 69 coupled to pulley 61 which is supported by the framework 70 at shaft 71. Tension belt 64 encompasses flywheel 63 with load actuator 66 connected for adjustment to vary the intensity of exercise on the exercise apparatus. Control system 68 is connected to load actuator 66 and track actuator 96 with wires 67,65,95 using conventional means. Control system 68 can be programmed to adjust tension belt 64 using load actuator 66 or to change the incline of tracks 90,94 using track actuator 96 to vary the intensity of exercise during operation. Framework 70 is attached to longitudinal frame members 74 which are attached to cross members 73,75 that are supported by a generally horizontal surface.

Operation begins when an operator places the feet upon the pedals 46,48 in the default side by side position of pedals 46,48. Moving the handles 36,38 and applying body weight to pedals 46,48 starts the crank arms 6,4 moving with ease. Holding handles 36,38 generally still as denoted by handle position 1', pedals 46,48 move through a relatively short pedal curve 1 shown in FIG. 1. Allowing the handles 36,38 to move through handle range 3' causes pedals 46,48 to move along pedal curve 3. Allowing handles 36,38 to move through handle range 5' results in pedal curve 5. Note that all pedal curves 1,3,5 are generally elliptical in shape.

In summary, the present invention has distinct advantages over prior art because the back and forth elliptical stride movement of the pedals 46,48 can be changed by the range of movement 1',3',5' of the handles 36,38 while maintaining a generally elliptical pedal curves 1,3,5 even for the longest pedal stride. Further, the exercise apparatus is easy to start.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus configured for operator motion determined stride length during operation comprising;

a framework, said framework configured to be supported on a generally horizontal surface;

a pair of crank arms, said crank arms being connected to rotate about a pivot axis on said framework;

a pair of foot support members, each said foot support member having a foot engaging pedal attached;

a pair of support links, each said support link pivotally connected at one end to a respective said crank arm and a respective said foot support member at the other end;

a pair of tracks, said tracks attached to said framework;

a pair of rollers, each said roller pivotally connected to a respective said foot support member and in rollable contact with a respective said track;

a pair of handles for arm exercise, each said handle pivotally connected to said framework;

a pair of connector links, each said connector link pivotally connected to a respective said handle and to a respective said support link intermediate said ends;

said crank arms, said support links, said connector links and said foot support members being configured to constrain said pedals to follow a shortest elongate curve path while said operator holds said handles stationary during operation;

a crossover assembly, said crossover assembly operably associated with said handles to cause one said handle to move in a direction opposed to the other said handle;

said pedals configured to move relative to said framework when the foot of said operator is rotating said crank arms whereby said pedals follow an elongate curve path wherein said stride length of the shortest to longest of said elongate curve path is determined by the position of said handles relative to said framework during movement of said operator.

2. The exercise apparatus according to claim 1 wherein said elongate curve path is generally elliptical in shape and the stride length of the shortest elongate curve path obtainable is significantly less than the stride length for the longest elongate curve path.

3. The exercise apparatus according to claim 1 wherein said crossover assembly comprises:

a crossover member, said crossover member pivotally connected to said framework intermediate the ends of said crossover member;

a pair of crossing links, each said crossing link pivotally connected to one end of said crossover member and to a respective said handle whereby forward movement of one said handle causes the rearward movement of the other said handle.

4. The exercise apparatus according to claim 1 further comprising a flywheel, said flywheel operably associated with said crank arms.

5. The exercise apparatus according to claim 1 further comprising a load resistance device, said load resistance device operably associated with said crank arms.

6. The exercise apparatus according to claim 5 wherein said load resistance device is adjustable to vary the intensity of exercise.

7. The exercise apparatus according to claim 6 further comprising a load actuator, said load actuator operably associated with said load resistance device and a control system to vary the intensity of exercise during operation of said exercise apparatus.

8. The exercise apparatus according to claim 1 further comprising a track actuator, said track actuator operably associated with said tracks and a control system to vary the intensity of exercise during operation of said exercise apparatus.

9. An exercise apparatus configured for operator motion determined stride length during operation comprising;

a framework, said framework configured to be supported on a generally horizontal surface;

a pair of crank arms, said crank arms being connected to rotate about a pivot axis on said framework;

a pair of foot support members, each said foot support member having a foot engaging pedal attached;

a pair of support links, each said support link pivotally connected at one end to a respective said crank arm and a respective said foot support member at the other end;

a pair of tracks, said tracks attached to said framework;

a pair of rollers, each said roller pivotally connected to a respective said foot support member and in rollable contact with a respective said track;

a pair of handles for arm exercise, each said handle pivotally connected to said framework;

a pair of connector links, each said connector link pivotally connected to a respective said handle and to a respective said support link intermediate said ends;

each respective said crank arm, said support link, said connector link and said foot support member being configured to constrain said pedal to follow a shortest elongate curve path while said operator holds said handle stationary during operation;

a crossover member, said crossover member pivotally connected to said framework intermediate the ends of said crossover member;

a pair of crossing links, each said crossing link pivotally connected to one end of said crossover member and to a respective said handle such that forward movement of one said handle causes the rearward movement of the other said handle;

said pedals configured to move relative to said framework when the foot of said operator is rotating said crank arms whereby said pedals follow a closed elongate curve path wherein the shortest to longest of said stride length of said elongate curve path is determined by the handle movement of said operator with the shortest said stride length of said closed elongate curve path occurring when the handles are held stationary allowing easy start-up of said exercise apparatus.

10. The exercise apparatus according to claim 9 further comprising a flywheel, said flywheel operably associated with said crank arms.

11. The exercise apparatus according to claim 9 further comprising a load resistance device, said load resistance device operably associated with said crank arms.

12. The exercise apparatus according to claim 11 wherein said load resistance device is adjustable to vary the intensity of exercise.

13. The exercise apparatus according to claim 12 further comprising a load actuator, said load actuator operably associated with said load resistance device and a control system to vary the intensity of exercise during operation of said exercise apparatus.

14. An exercise apparatus configured for operator motion determined stride length during operation comprising;

a framework, said framework configured to be supported on a generally horizontal surface;

a pair of crank arms, said crank arms being connected to rotate about a pivot axis on said framework;

a pair of foot support members, each said foot support member having a first portion, a second portion and a foot engaging pedal;

a pair of support links, each said support link pivotally connected at one end to a respective said crank arm and a respective said foot support member at the other end to cause said first portion of said foot support member to have a generally up and down movement;

a pair of tracks, said tracks attached to said framework;

a pair of rollers, each said roller pivotally connected to a respective said foot support member and in rollable contact with a respective said track to cause said second portion of said foot support member to have a generally back and forth movement;

a pair of handles for arm exercise, each said handle pivotally connected to said framework rearward of said pivot axis;

a pair of connector links, each said connector link pivotally connected to a respective said handle and to a respective said support link intermediate the ends;

each said crank arm, said support link, said connector link and said foot support member being configured to constrain said pedal to follow a shortest elongate curve path while said operator holds said handle stationary during operation;

a crossover assembly, said crossover assembly operably associated with said handles to cause one said handle to move in a direction opposed to the other said handle;

said pedals configured to move relative to said framework when the foot of said operator is rotating said crank arms whereby said pedals follow said elongate curve path wherein said stride length of said elongate curve path is determined by the range of movement of said handles.

15. The exercise apparatus according to claim 14 wherein said foot support member is configured with said pedal on one end and said first portion at the other end with said second portion intermediate the ends.

16. The exercise apparatus according to claim 14 wherein said crossover assembly comprises:

a crossover member, said crossover member pivotally connected to said framework intermediate the ends of said crossover member;

a pair of crossing links, each said crossing link pivotally connected to one end of said crossover member and to a respective said handle whereby forward movement of one said handle causes the rearward movement of the other said handle.

17. The exercise apparatus according to claim 14 further comprising a flywheel, said flywheel operably associated with said crank arms and a load resistance device, said load resistance device operably associated with said flywheel.

18. The exercise apparatus according to claim 17 wherein said load resistance device is adjustable to vary the intensity of exercise.

19. The exercise apparatus according to claim 18 further comprising a load actuator, said load actuator operably associated with said load resistance device and a control system to vary the intensity of exercise during operation of said exercise apparatus.

20. The exercise apparatus according to claim 14 further comprising a track actuator, said track actuator operably associated with said tracks and a control system to vary the intensity of exercise during operation of said exercise apparatus.

* * * * *